United States Patent [19]

Yerly

[11] Patent Number: 5,065,926

[45] Date of Patent: Nov. 19, 1991

[54] TELESCOPIC TOOL FOR STRIPPING WASTE WITHIN A SHEET PROCESSING MACHINE

[75] Inventor: Marcel Yerly, Jouxtens, Switzerland

[73] Assignee: Bobst SA, Switzerland

[21] Appl. No.: 505,508

[22] Filed: Apr. 6, 1990

[30] Foreign Application Priority Data

Apr. 7, 1989 [CH] Switzerland ..... 01313/89

[51] Int. Cl.[5] ..... B26F 3/02; B31B 49/00

[52] U.S. Cl. ..... 225/93; 225/97

[58] Field of Search ..... 225/93, 97, 100, 103, 225/1; 493/342, 354, 373; 227/147; 173/139; 83/103, 128, 139

[56] References Cited

U.S. PATENT DOCUMENTS

| | | | |
|---|---|---|---|
| 2,768,560 | 10/1956 | Hirson | 493/354 X |
| 3,552,615 | 1/1971 | Murray | 225/97 |
| 3,784,070 | 1/1974 | Vossen | 225/1 |
| 3,956,974 | 5/1970 | Schroter | 493/342 |
| 4,051,754 | 10/1977 | Harcuba et al. | 83/128 X |
| 4,367,069 | 1/1983 | Bishop | 225/97 X |
| 4,691,602 | 9/1987 | Schlueter | 83/128 |
| 4,723,466 | 2/1988 | Pottorff | 83/139 X |
| 4,867,366 | 9/1989 | Kleinholz | 173/139 X |

FOREIGN PATENT DOCUMENTS 2158907 6/1973 Fed. Rep. of Germany .

*Primary Examiner*—Douglas D. Watts
*Assistant Examiner*—Rinaldi Rada
*Attorney, Agent, or Firm*—Hill, Van Santen, Steadman & Simpson

[57] ABSTRACT

A telescopic tool used for stripping waste from a cut sheet of material in a waste stripping station comprises a hollow cylindrical body which receives a pin having a portion extending out of a bore of the body with a tip for engaging the waste material. The tip is formed of a deformable material, while the remaining portion of the pin is of a rigid, hardened material. The pin has a collar received in the interior of the body which engages an internal shoulder and to absorb noise, the pin is provided with an elastic element adjacent to the collar to be interposed between the collar and shoulder.

10 Claims, 1 Drawing Sheet

TELESCOPIC TOOL FOR STRIPPING WASTE WITHIN A SHEET PROCESSING MACHINE

BACKGROUND OF THE INVENTION

The present invention is directed to a telescopic tool for stripping waste from a sheet processing machine, which tool includes a cylindrical body having a pin extending from one end of the body. The cylindrical body has a first bore which forms an internal shoulder with a second smaller bore and the pin has two end portions separated by a collar. The pin is received in the first and second bore with the collar being biased by a spring acting between a cap closing the first bore against the shoulder with one portion of the pin extending out of the second bore. The cap includes a bore or passage for guiding the other end of the pin as it is shifted from a position with the collar engaging the shoulder to an inward position.

A telescopic tool of this type is known to the users as currently utilized for stripping waste from sheets being processed in a machine, such as a board sheet cutter.

In a waste stripping station of a cutting press, the tools are fitted on upper and lower frames consisting of movable crossbars in such a way as to be set according to the position of the waste. Such a use is shown by U.S. Pat. No. 3,784,070, whose disclosure is incorporated herein by reference thereto and which corresponds to German Patent No. 2,158,907.

Generally, these frames are imparted with a vertical reciprocal movement destined to apply the points of the upper and lower pins of the tools onto the surface of the waste so as to pinch the waste between the ends during a first stage of operation. During a second stage, the pair of pins move the waste downward to a plane different from that of the sheet so as to strip the waste from the sheet and then the pins separate to drop the waste as the frames move back to the original position to withdraw the pins from the sheet being processed. During the course of this stripping action, the pins will move to and fro within the hollow cylindrical body. Also during this stripping process, the conveyors of the press are in a dwell period and hold the sheet in a fixed position in the stripping station. Then, as the process is completed, the conveyors will move the sheet stripped of its waste to the next station as the next sheet to be stripped is moved into the stripping station.

The sheets generally contain a large number of waste bits, for which reason the upper and lower frames are equipped with an adequate number of telescopic tools. Conspicuously, the assembly comprising the frames and the tools represent a certain mass with considerable inherent inertia in case of high-speed presses used in this field, so that the press will be powered accordingly.

Up to now, the hollow cylindrical body has been made out of aluminum or aluminum alloy and the pins have been constructed of steel.

The use of such telescopic tools fitted on their upper and lower frames involves numerous drawbacks with production speeds of the press being further increased. The first of these drawbacks is the noise that results from the impact of the steel pins on the waste. The second drawback is the blunting of the pin points or ends which, in the event of advanced wear, will cause the pins to be squeezed or shifted laterally in the bores machined in the hollow cylindrical bodies to decrease the amount of pressure exerted by the pin points on the waste. It has effectively been noticed that in the course of production runs, the pin points could wear as far as to take on an oblique plane. In certain cases, the pins even break due to the lateral stresses caused by the wearing of their points.

The oblique wearing of the pin point can be caused either by an inadequate positioning of the upper pin with regard to the lower one or by an inaccurate fitting of the tool on the frame. For example, the tool being slightly obliquely arranged on the frame.

A third drawback consists in the heavy structure of every telescopic tool compelling the designer of the cutting press to adopt a largely dimensioned drive assembly, which arrangement will have a negative influence on the wanted increase in the production speed.

SUMMARY OF THE INVENTION

The object of the present invention is to solve the above-mentioned problems without complicating the actual principles of the design and without unduly increasing the price of the telescopic tool. The invention particularly presents the advantage of creating a pin point with a perfect contact with the waste, though preventing the pin from being squeezed and without consideration given to the pin's plane acting on the waste. Moreover, the flexibility of a deformable element considerably reduces the wear of the sides getting in contact with the waste and this reduction has a non-negative influence on the tool's durability and insures a better grip of the waste.

To accomplish these goals, the present invention is directed to an improvement in a telescopic tool for stripping waste within a sheet processing machine, said tool consisting of a hollow cylindrical body having a first bore or passage of a first diameter forming an internal shoulder with a second bore or passage of a smaller diameter than the first passage, said first bore opposite the internal shoulder having a cap with a third passage aligned with the second bore, a pin having a first portion separated from a second portion by a collar being disposed in said body with the first portion and collar being arranged in the first bore and the second portion being held in the second passage with an end extending out of the second passage, and biasing means acting between the cap and the collar to bias the collar against said shoulder as the pin is guided in the second passage and the passage of the cap. The improvements are that the second portion of the pin is formed of a first part or element and a second part or element, with the second part being at the end of the second portion of the pin and the tool is equipped with means for absorbing noise being placed between the collar and the internal shoulder of the cylindrical body. Preferably, the hollow cylindrical body is made of a synthetic material and the second part of the pin is a deformable element and the first part is a rigid element. The means for absorbing noise may be formed by a ring of an elastomer material received on the pin.

Other advantages and features of the invention will be readily apparent from the following description of the preferred embodiments, the drawing and claims.

BRIEF DESCRIPTION OF THE DRAWING

The Figure is a longitudinal cross sectional view with portions in elevation for purposes of illustration of the telescopic tool in accordance with the present invention.

DESCRIPTION OF THE PREFERRED EMBODIMENTS

Figure 1:
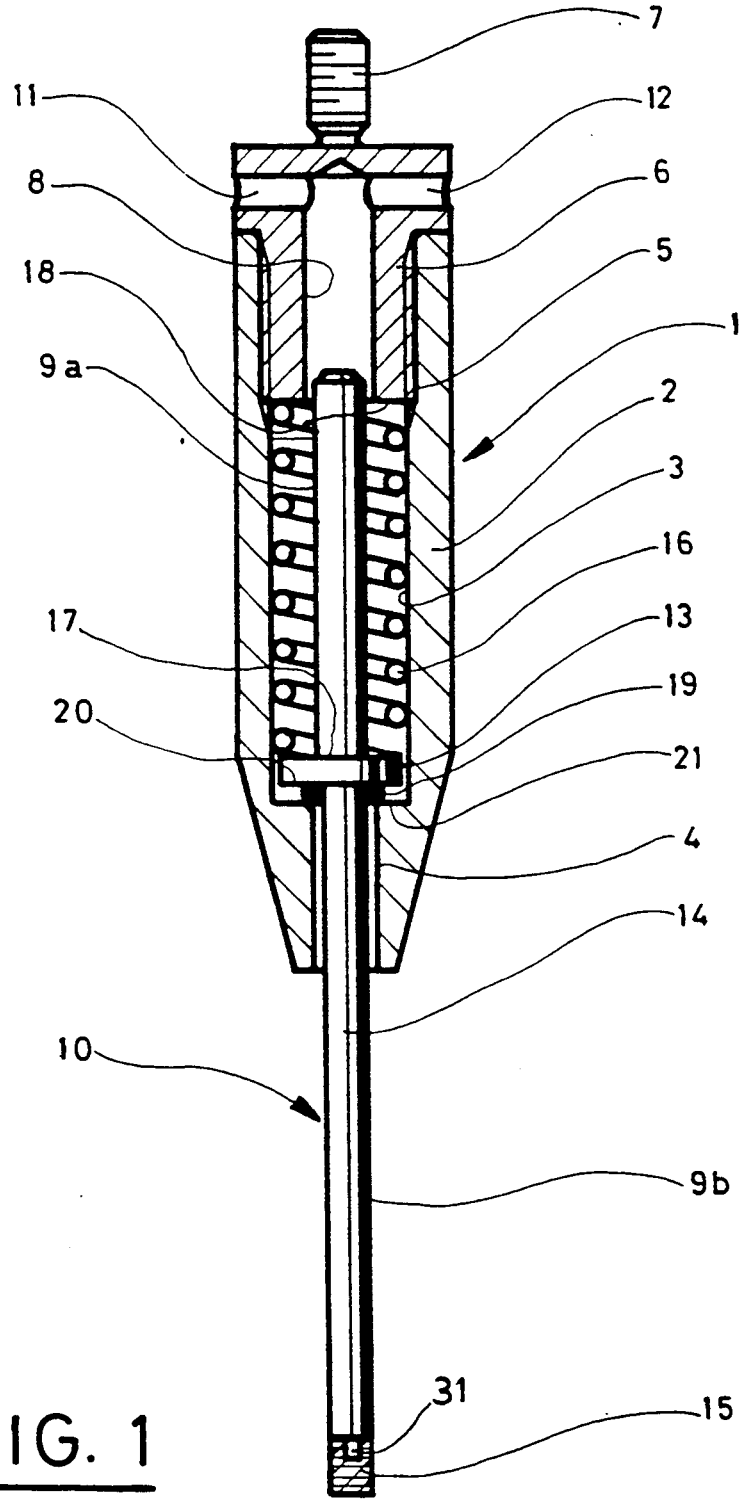

The principles of the present invention are particularly useful when incorporated in a telescopic tool, generally indicated at 1 in the Figure.

The tool 1 is formed of a hollow cylindrical body or housing 2, which is preferably made of a synthetic material. The body or housing 2 has a first bore or passage 3 which was machined therein and has a second bore or passage 4 of a smaller diameter extending from the passage 3 to form an internal shoulder 21. At an upper end opposite the shoulder 21, the first bore has threads 5 into which a top or cap 6 is threaded into for securement. The top or cap 6 is arranged in such a way to have an external threaded member 7 which is provided to fix the tool on a support of a stripping frame (not represented) of the stripping station. The top 6 also has a guiding bore or third passageway 8 of a diameter smaller than the diameter of the first bore and approximately the same as the diameter of the second bore 4, and this bore 8 receives an end portion 9*a* of a pin 10. The cap or top 6 also has two lateral extending bores or holes 11 and 12 which extend radially outward from the guiding bore 8. These holes 11 and 12 are, on the one hand, exhaust ducts for air and dust which may penetrate into the telescopic tool during operation and, on the other hand, provide tightening means for securing the tool on its support by the introduction of a shaft into the two holes 11 and 12 in order to interlock the threaded portion 7 in a support.

The pin 10, in addition to having the portion 9*a*, has a second portion 9*b* separated from the portion 9*a* by a collar 13. This second portion or front part 9*b* of the pin 10 consists of a rigid element 14 and a deformable element 15.

The first portion or rear part 9*a* of the pin 10 is surrounded by a compression spring 16 which presses against a side 17 of the collar 13 and also against an end 18 of the top or cap 6 to form biasing means for urging the collar against the shoulder 21.

The front part or second portion 9*b* of the pin is guided in the second bore 4 and is provided with means for absorbing noise, which is preferably an annular ring 19, which is positioned between a side 20 of the collar 13 and the shoulder 21 of the first bore 3. The first and second portions 9*a* and 9*b* of the pin 9 slide freely in their two bores 8 and 4, respectively.

The rigid element 14 of the second portion 9*b* of the pin is preferably made of an aluminum shaft of which the periphery or outer surface has been hardened by an anodic oxidation or by anodizing treatment. It is to be mentioned that the whole pin can be treated so as to be provided with a hardened outer surface.

The deformable element 15 can be of an elastomer, such as a polyethylene, and can be fixed to the rigid element by vulcanization or possibly with glue or any other permanent fixing means. To help guide the part 15 on the end of the second portion 9*b*, the second portion is provided with an axial extending projection 31 which is received in the recess provided on the member 15.

In addition to the above-mentioned materials for the member 15, other elastomers, such as natural and synthetic rubber, polyacrylates or a neoprene could be used for the material of the deformable element 15. The elastomer could also be replaced by any other means having a similar elastic quantity. The noise absorbing device, such as the ring 19, is preferably formed by an elastomer ring having the same characteristics as the material used for the deformable element 15.

The improved tool 1 allows the reduction in the inertia forces developed by its structure. It allows for a reduction in the noise of the stripping station. It also enables an angular position error of the tool with regard to the plane of the waste material to be corrected and removes the risk of squeezing and/or jamming of the pin in the guiding bore machined in the hollow cylindrical body of the telescopic tool. In addition, as mentioned hereinabove, the deformable portion 15 provides a better gripping of the waste as the waste is pinched between both the upper and lower tools, which are both constructed to be identical.

Although various minor modifications may be suggested by those versed in the art, it should be understood that I wish to embody within the scope of the patent granted hereon all such modifications as reasonably and properly come within the scope of my contribution to the art.

I claim:

1. In a telescopic toll for stripping waste within a sheet processing machine, said tool comprising a hollow cylindrical body having a first bore, a second bore extending axially from the first bore and coacting therewith to form an internal shoulder, said first bore receiving a cap to close the first bore, said cap having a third bore axially aligned with the first and second bores, a pin having a first portion and a second portion separated by a collar being disposed with the second portion and collar received in the first bore and the second portion extending in the second bore and out of the tool and biasing means comprising a spring between the collar and the end of the cap to urge the collar toward the internal shoulder, the improvements comprising the second portion being formed of a first element and a second element connected to one another with the second element forming tip for the tool, said second and first elements being of different materials with the material of the second element forming means for absorbing shocks and misalignment and said tool having means for absorbing noise being disposed between the collar and the internal shoulder.

2. In a telescopic tool according to claim 1, wherein the means for absorbing noise comprises an elastomer ring received on the pin.

3. In a telescopic tool according to claim 1, wherein the hollow cylindrical body is formed of a synthetic material.

4. In a telescopic tool according to claim 1, wherein the first element of the second portion of the pin is a rigid element and the second element of the second portion of the pin is a deformable element.

5. In a telescopic tool according to claim 4, wherein the deformable element is made of an elastomer and is secured on the end of the rigid element by vulcanization.

6. In a telescopic tool according to claim 4, wherein the rigid element consists of an aluminum shaft with a hardened surface.

7. In a telescopic tool according to claim 6, wherein the aluminum shaft is hardened by anodic oxidation.

8. In a telescopic tool according to claim 6, wherein the second element is made of an elastomer material secured onto the end of the aluminum shaft.

9. In a telescopic tool according to claim 6, wherein the means for absorbing noise is an elastomer material disposed on the pin adjacent the collar.

10. In a telescopic tool according to claim 9, wherein said hollow cylindrical body is formed of a synthetic material.

* * * * *